United States Patent [19]

Daido et al.

[11] 4,217,841

[45] Aug. 19, 1980

[54] SPEED CONTROL APPARATUS FOR USE WITH ELECTRIC SEWING MACHINE

[75] Inventors: Toshihiko Daido, Nara; Kiyoshi Koreeda; Hiroshi Kunimatsu, both of Osaka; Kinji Tabata, Nara, all of Japan

[73] Assignees: Koyo Seiko Company Limited; Koyo Machine Industries Company Limited, both of Osaka, Japan

[21] Appl. No.: 966,158

[22] Filed: Nov. 29, 1978

[30] Foreign Application Priority Data

Apr. 6, 1978 [JP] Japan ..... 53-40858

[51] Int. Cl.[2] ..... D05B 69/18

[52] U.S. Cl. ..... 112/277

[58] Field of Search ..... 112/277, 275, 121.11, 112/220

[56] References Cited

U.S. PATENT DOCUMENTS

| | | | |
|---|---|---|---|
| 4,075,961 | 2/1978 | Harris | 112/277 |
| 4,150,634 | 4/1979 | Brown et al. | 112/275 |

*Primary Examiner*—Peter P. Nerbun

*Attorney, Agent, or Firm*—Mason, Fenwick & Lawrence

[57] ABSTRACT

A speed control apparatus for use with an electric sewing machine having a motor drive control device for controlling the drive of the motor. The apparatus comprises a sensing device which can be optionally touched by the operator of the sewing machine, and a sensing signal generating circuit adapted to generate a signal in response to an electric change which is caused when the human body touches the sensing device, the arrangement being such that in response to the operator of the sewing machine touching the sensing device, the sensing signal generating circuit gives a predetermined signal to the motor drive control device, thereby stopping the drive of the motor.

2 Claims, 6 Drawing Figures

SPEED CONTROL APPARATUS FOR USE WITH ELECTRIC SEWING MACHINE

BACKGROUND OF THE INVENTION

The present invention relates to a speed control apparatus for use with an electric sewing machine.

In recent years, sewing machines of the conventional type in which the rotative speed control thereof is effected by treading action have been largely superseded by a sewing machine so designed that said control is effected by button operation. Generally, the sewing machine in which the rotative speed is controlled by button operation as described above comprises, as shown in FIG. 1, a plurality of speed selection buttons A for selecting desired rotative speeds of the sewing machine, and a stop button B for stopping the sewing machine, said buttons A and B being juxtaposed on the right-hand side of the machine body, the arrangement being such that depressing a predetermined one of the speed selection buttons associated with respective preset speeds gives a desired speed to the machine and that when it is desried to stop the machine, this is achieved by depressing the stop button B included in said group of buttons. However, in sewing operation by machine, the operator's two hands are placed on the cloth, with his or her eyes directed on the tip of the sewing-machine needle, so that, with said speed selection buttons A and B located on the right-hand side of the machine body remote from the tip of the needle, when the sewing approaches the terminal stitch portion which is most difficult to work, it is necessary for the operator not only to shift one of his or her two hands placed on the cloth to the stop button with the proper timing for stopping the machine but also to turn his or her eyes away from the needle in order to ascertain the position of the button. Such operation makes it more difficult and complicated for unskilled persons to do the sewing. Further, in the sewing machine disclosed in Japanese Pat. Lay-Open No. 112,645/73, as show in FIG. 2, a lever D is provided on the needle attaching side of the machine arm C for starting and stopping the drive motor while speed selection buttons E alone are located on the right-hand side of the machine arm C, the arrangement being such that when it is desired to start the machine, this is achieved by first depressing the speed selection button which is associated with a desired rotative speed and then turning on the lever D and that the machine can be stopped by turning off the lever D. Althugh this machine may be said to have been improved as compared with the one shown in FIG. 1 in that it is no longer necessary for the operator to turn his or her eyes away from the needle, the machine is no different from the one shown in FIG. 1 in that in order to operate the lever D, it is necessary for the operator to shift one of his or her two hands placed on the cloth to the lever D. Moreover, in the case of this machine, the addition of the lever D results in the operating parts being distributed at two places, and it can hardly be said from the standpoint of operation that this apparatus is simplified. Further, constituting said buttons by machanical buttons makes it difficult to arrange them as desired, in consideration of the space of the machine. If an arrangement wherein the stop button is located adjacent the base of the needle in order to make it possible to stop the machine without shifting the hand placed on the cloth during sewing operation is applied to the machine shown in FIG. 1, it is necessary to mechanically interlock the speed selection buttons, which, in this case, should also act as start switches, with the stop button located away from said speed selection buttons so that a stop instruction operation by the stop button will reset the speed selection button. This has the disadvantage of complicating the apparatus. Further, in the sewing machine so designed that its rotation is controlled by button operation, a danger can occur that a button is accidentally held depressed as the sewing machine is taken out of its receptacle, without the knowledge of the operator, who then turns on the power, whereupon the machine is accidentally started. In order to prevent this, it is necessary to provide a complicated safety circuit such as disclosed in Japanese Patent Lay-Open No. 61,351/76. Thus, the apparatus will be complicated also from this point of view.

SUMMARY OF THE INVENTION

The present invention is intended to provide a speed control apparatus for use with an electric sewing machine, which eliminates the above described drawbacks inherent in the conventional apparatus, comprising a particular sensing section which can be simply installed at a position where it is easily accesible to the operator during sewing operation with his or her hands kept placed on the cloth, the arrangement being such that a change in capacity or in other electric quantity, such as hum input, produced at said sensing section when the latter is touched with the human body is converted into a control signal, whereby the rotation of the drive motor is controlled.

DESCRIPTION OF THE PREFERRED EMBODIMENT

Figure 1:
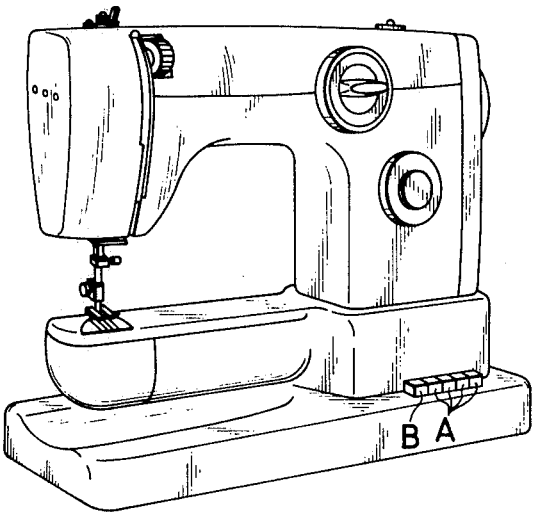
FIG. 1 is an external perspective view of a conventional electric sewing machine with operating buttons located remote from the base of the sewing-machine needle.
Figure 2:
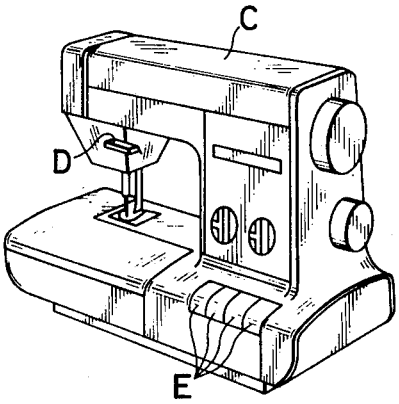
FIG. 2 is an external perspective view of another example of a conventional electric sewing machine.
Figure 3:
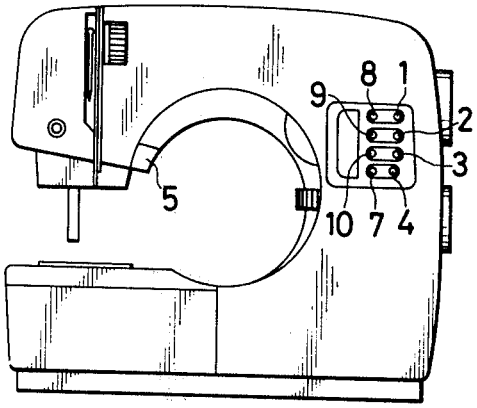
FIG. 3 is a front view illustrating the position where sensing plates for an electric sewing machine according to an embodiment of the invention are installed.
Figure 4:
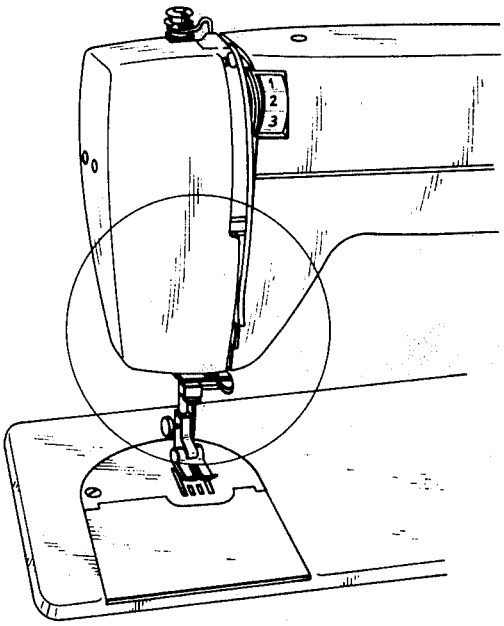
FIG. 4 is a perspective view of an electric sewing machine for explaining the area around the base of the sewing-machine needle.
Figure 5:
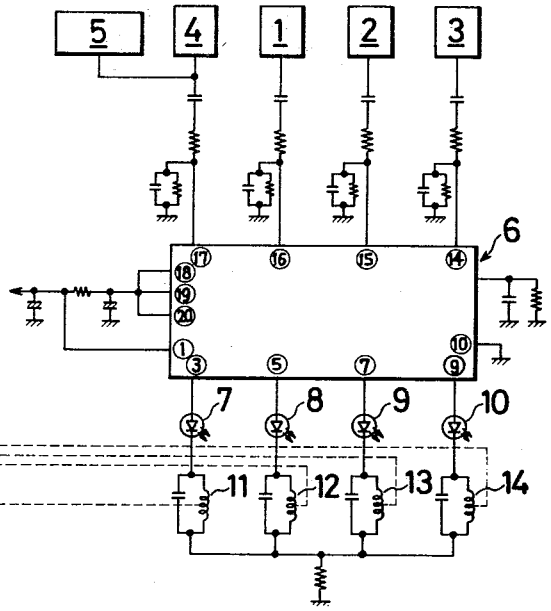
FIG. 5 is a circuit diagram illustrating a sensing signal generating circuit adopted in the embodiment of the invention and appurtenant circuits belonging thereto.
Figure 6:
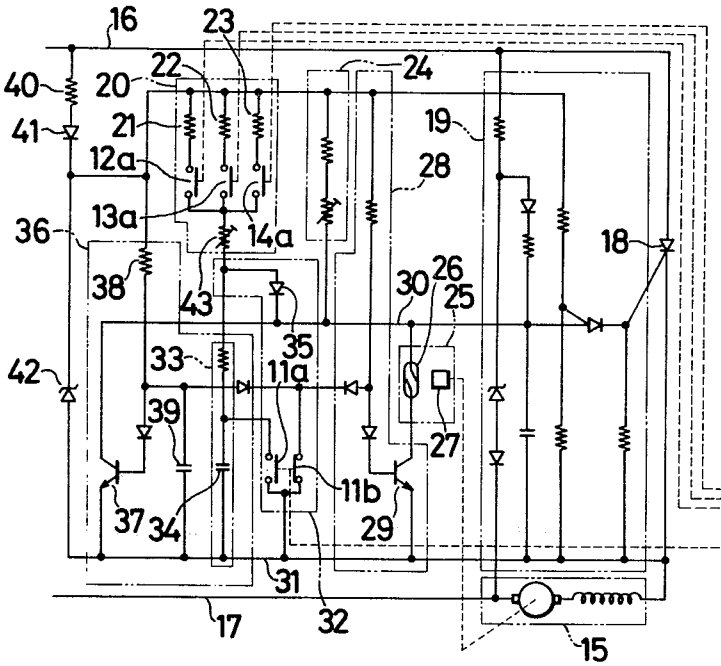
FIG. 6 is a circuit diagram illustrating a device associated with the sensing signal generating circuit of FIG. 5 for stopping the electric sewing-machine needle at a fixed position.

An embodiment of the present invention will now be described. In FIG. 3, the numerals 1, 2, 3, 4 and 5 designate sensing plates fixed to the sewing machine body in electrically insulated relation thereto, of which the sensing plates 1, 2 and 3 are speed selection sensing plates for low, medium and high speed, respectively, which specify the rotative speed of the drive motor, and the sensing plates 4 and 5 are provided for giving stop instructions. The sensing plates 1, 2, 3, 4 and 5 are connected to a sensing signal generating circuit 6 which is housed in the machine body and by which a change in capacity or in other electric quantity, such as hum input, produced when any of said sensing plate is touched with the human body is converted into a predetermined electric signal. FIG. 5 illustrates a wiring suitable for use when an integrated circuit "PC 1009C" manufactured by Nippon Electric Company, Ltd., is employed as said sensing singnal generating circuit 6, but the invention is not limited thereto and other circuits equivalent in function thereto may, of course, be used. In the sensing signal generating circuit 6 manufactured by Nippon Electric Company, Ltd., shown in FIG. 5, input terminals ⑰, ⑯, ⑮ and ⑭ correspond to output terminals ③, ⑤, ⑦, and ⑨, the arrangement being such that hum inputs received at the input terminals ⑰, ⑯, ⑮ and ⑭ are converted into sufficient electric signals to drive light-emitting diodes 7, 8, 9 and 10 connected to the output terminals ③, ⑤, ⑦ and ⑨ and relays 11, 12, 13 and 14, said signals being delivered from the corresponding output terminals. Further, said sensing signal generating circuit 6 is so arranged that the input terminal ③ will deliver an output in response to a power source input as well as to an output from the input terminal ⑰. In addition, in said sensing signal generating circuit 6, the characters ⑱, ⑲, ⑳ and ① designate power source input terminals. Thus, the sensing plates 4 and 5 for stop instructions are connected to the input terminal ⑰ of the sensing signal generating circuit 6, the speed selection sensing plate 1 for low speed to the input terminal ⑯, the sensing plate 3 for medium speed to the input terminal ⑮, and the sensing plate 3 for high speed to the input terminal ⑭. Therefore, it follows that the sensing plates 4 and 5 for stop instructions and the power source are associated with the light-emitting diode 7 and relay 11, the speed selection sensing plate 1 for low speed with the light-emitting diode 8 and relay 12, the sensing plate 2 for medium speed with the light-emitting diode 9 and relay 13, and the sensing plate 3 for high speed with the light-emitting diode 10 and relay 14. Of said sensing plates 1, 2, 3, 4 and 5, the speed selection sensing plates 1, 2 and 3 and the first stop instruction sensing plate 4 are located on the front surface of the machine arm at the right-hand side base thereof, as show in FIG. 3, and the second stop instruction sensing plate 5 is located on the machine arm adjacent the front end thereof, as shown in FIG. 3, where it is possible to press the back of one of the hands against the plate with the other hand maintained placed on the cloth during sewing operation, or adjacent the base of the needle shown in FIG. 4 enclosed within a circle, where it is possible to bring into contact with it at least a portion of one hand placed on the cloth during sewing operation. The circuit shown in FIG. 6 is a control circuit having the function of selectively determining the rotative speed of a direct drive motor 15 controlled by the action of said relays 11, 12, 13 and 14, and the function of controlling the sewing-machine needle so that it will be stopped at a fixed position when the machine is stopped, said circuit being based on the same principle as that of the circuit described in "Device for Stopping Sewing-Machine Needle at Fixed Position" (Japanese Patent Application No. 131071/76). The arrangement of this circuit will be outlined below.

The gate of a controlled rectifier element 18 connected between a.c. power source lines 16 and 17 and in series with the drive motor 15 which drives the sewing machine has connected thereto a gate trigger signal generating device 19 for rendering said rectifier element conductive. The numeral 20 designates a speed regulating circuit adapted to apply a predetermined voltage to said gate trigger signal generating circuit 19 to enable the latter to produce such a gate current as will drive the drive motor 15 at a rotative speed which is appropriate for ordinary sewing speed, said speed regulating circuit comprising three branch circuits for low, medium and high speed, respectively, which are constituted by connecting the normally open contacts 12*a*, 13*a* and 14*a* of the relays 12, 13 and 14 of FIG. 5 in series with resistors 21, 22 and 23, respectively. The numeral 24 designates a deceleration regulating circuit for preparation for stoppage, designed to feed the gate trigger signal generating device 19 with a voltage lower than in the case of said speed regulating circuit. The numeral 25 designates a stop position detecting device comprising a reed switch 26 and a magnet 27, said magnet 27 being disposed on the fly-wheel of the sewing machine, said reed switch 26 being disposed on the stationary part of the machine head opposed to the fly-wheel. The numeral 28 designates a stopping device for stopping the conduction of the controlled rectifier element 18 by making a short between an input line 30 for said gate trigger signal generating device 19 and an earth line 31 by the conduction of a transistor 29 and the closing of said reed switch 26 so as to prevent the actuation of the gate trigger signal generating circuit 19. The numeral 32 designates a stop instruction device adapted to receive stop instructions from the sensing signal generating circuit 6 shown in FIG. 5 and give actuation instructions to said stopping device and to a stop holding device 36 to be later described. The stop instruction device comprises a normally closed contact 11*b* which makes and breaks the connection between the bias circuit for the transistors 29 and 37 and the earth line 31, a normally open contact 11*a* whereby a capacitor 34 in a slow start circuit 33 connected between the speed regulating circuit 20 and the earth line 31 is connected to and disconnected from the earth line 31, and a diode 35 which connects the input line 30 of the gate trigger signal generating device 19 to the speed regulating circuit 20. The normally open contact 11*a* and normally closed contact 11*b* are the contacts of the relay 11 shown in FIG. 5. The stop holding device designated at 36 operates in such a manner that after the sewing machine is stopped by the action of said stopping device 28 and said stop position detecting device 25, it maintains the stopped state of the machine. This holding action is achieved by making a short between the input line 30 and the earth line 31 through the conduction of the transistor 37, the time constant of a combination of the resistor 38 and capacitor 39 which constitute the base circuit of said transistor 37 being such that the bias is applied to the transistor 37 after the stoppage of the sewing machine as a result of the actuation of the stopping device 28 and stop position detecting device 25 caused by the opening of the normally closed contact 11*b* of the stop instruction device 32 which is kept closed during the driving of the machine. The power circuit of said speed regulating circuit 20, deceleration regulating circuit 24, stopping device 28 and stop holding device 36 is constituted by series-connecting a resistor 40, a diode 41 and a zener diode 42 between the a.c. power line 16 and the earth line 31.

The embodiment arranged in the manner described above operates as follows.

When the power is turned on, a signal is delivered only from the output terminal ③ of the sensing signal generating circuit 6, firing the light-emitting diode 7 and energizing the relay 11. At this moment, therefore, in the stop instruction device 32 for the needle fixed-position stopping device, the normally closed contact 11*b* is in the opened state and the normally open contact 11*a* in the closed state, while the normally open contacts 12*a*, 13*a* and 14*a* in the speed regulating circuit 20 are all open. In such initial state, since the transistor 29 of the stopping device 28 and the transistor 37 of the stop holding device 36 are being biased and conducting, the combined action of the closing of the reed switch 26 of the stop position detecting device 25 and the conduction of the transistor 29 of the stopping device 28, coupled with the conduction of the transistor 37 of the stop holding device 36, makes a short between the input line 30 and the earth line 31. Thus, since there is no predetermined voltage applied to the gate trigger signal generating device 28, the controlled rectifier element 18 is not conducting and hence the drive motor 15 is in the stopped state. When the sewing-machine operator then touches any of the sensing plates 1, 2 and 3 for low, medium and high speed, respectively, e.g., the sensing plate 2 for medium speed, the hum input received at the input terminal ⑮ causes the sensing signal generating circuit 6 to deliver a predetermined output signal from the output terminal ⑦ thereby driving the light-emitting diode 9 and relay 13. Concurrently therewith, the output terminal ③ stops delivering output and the diode 7 and relay 11 stop driving. In the needle fixed-position stopping device, therefore, the stop instruction device 32 has its normally open contact 11*a* opened and normally closed contact 13*a* closed. The transistor 29 of the stopping device 28 and the transistor 37 of the stop holding device 36 are both rendered non-conductive, breaking the connection between the input line 30 and the earth line 31 and charging the capacitor 34 of the slow start circuit 33 through the speed regulating circuit 20, and a gradually increasing signal is sent to the gate trigger signal generating device 19 through the diode 35. The controlled rectifier element 18, receiving the gate signal from said gate trigger signal generating device, becomes conductive, and the drive motor 15 is gradually accelerated to the medium rotative speed. Therefore, it is possible for a beginner to have sufficient time to place his or her hands on the cloth after the selection of a speed is made. If the operator touches any of the sensing plates 1, 2 and 3 during sewing operation, the drive motor 15 will be caused to change its rotative speed to the value associated with that sensing plate. In order to stop the sewing machine, one of the hands placed on the cloth may be brought into touch with the first stop instruction sensing plate 4 disposed on the front of the right-hand side base of the sewing-machine arm, or in the case of a beginner who is not skillful in removing the hand from the cloth, it may be achieved by bringing the back or other part of one hand into touch with the second stop instruction sensing plate 5 disposed adjacent the base of the needle while keeping both hands placed on the cloth. This operation results in applying a hum input to the input terminal ⑰ of the sensing signal generating circuit 6, sending a signal from the output terminal ③, and concurrently therewith the output terminal ⑤ ⑦ or ⑨ which is sending a signal to this moment stops sending the signal. As a result, the light-emitting diode 7 is fired to drive the relay 11, so that in the needle fixed-position stopping device, the stop instruction device 32 has its normally open contact 11*a* closed and its normally closed contact 11*b* opened while the speed regulating circuit 20 has its normally open contacts 12*a*, 13*a* and 14*a* all opened. Therefore, at this instant, the capacitor 34 in the slow start circuit 33 is discharged through the earth line 31, so that the input voltage for the gate trigger signal generating device 19 is supplied from the deceleration regulating circuit 24 whose resistance is set at a sufficiently higher value than the combined resistance of the individual branch circuit of the speed regulating circuit 20 and a variable resistor 43. As soon as the drive motor 15 is decelerated, a bias is applied to the transistor 29 of the stopping device 28. When the sewing-machine needle reaches an upper position where it has been withdrawn from the throat plate a sufficient distance, the reed switch 26 is closed by the magnet 27 of the stop position detecting device 25, rendering the transistor 29 conductive to make a short between the input line 30 and the earth line 31, thereby stopping the drive motor 15. Thereafter, the capacitor 39 of the stop holding device 36 is sufficiently charged to apply a bias to the transistor 37, so that the latter is rendered conductive, making a short between the input line 30 and the earth line 31. Therefore, even if the operator thereafter accidentally touches the sewing machine to cause the needle stop position to be shifted to a position where the magnet 27 does not act on the reed switch 26, the machine will be maintained in the stopped state.

According to the present invention, since the sensing section adapted to give stop instructions to the machine upon being touched with the human body is located adjacent the base of the sewing-machine needle or at another place which allows the operator to touch it with a finger or the back of his or her hand while placing the hands on the cloth, there is no need for the operator to remove his or her hands from the cloth for stop instruction operation, which means that the sewing operation is greately simplified for unskilled persons. Further, in this invention, since the interlocking mechanism designed so that the previous instruction is automatically canceled by a new instruction is operated by the sensing signal generating circuit electrically connected to the sensing section, there is no restriction or requirements that said interlocking mechanism be positioned adjacent the buttons which are directly touchable by the operator, as in the conventional apparatus. Thus, since it can be installed at substantially any desired position to perform said interlocking operation, the sensing section can be installed at any position convenient for operation, so that the design is easy and the construction is greately simplified. Further, besides being installed in such a manner as to be touchable intentionally by the operator, the stop instruction sensing section may be installed in insulated relation to the machine body at the presser or the needle base guard or other part which is dangerous if touched during sewing operation. In that case, it will serve as a safety device to put an emergency stop to the machine when a finger or other part of the human body touches such dangerous part.

What is claimed is:

1. A speed control apparatus for use with an electric sewing machine having motor drive control means for controlling the drive of the motor, said apparatus comprising a sensing device which can be optionally contacted by the operator of the sewing machine, and a sensing signal generating circuit having means to condition the motor in a driven state or condition the motor in a stopped state and latch the motor in the selected state and generate a latch signal in response to an electrical change which is caused when the human body touches said sensing device, the arrangement being such that in response to the operator of the sewing machine touching said sensing device, said sensing signal generating circuit including means for supplying the latch signal to the motor drive control means to drive the motor or cause the motor to stop a sewing machine needle at a predetermined position, said sensing device being provided adjacent to the needle at least for stopping the motor drive.

2. A speed control apparatus for use with an electric sewing machine as set forth in claim 1, wherein said sensing signal generating circuit has the function of being initially reset in response to the power being turned on so as to cause the motor to be placed in the stopped state, latch the same state and supply the latch signal to the motor drive control circuit.

* * * * *